United States Patent [19]

Metzner et al.

[11] 3,938,536

[45] Feb. 17, 1976

[54] PROCESS FOR REDUCING THE TURBULENT DRAG IN CONDUITS AND AROUND SUBMERGED OBJECTS

[75] Inventors: Arthur B. Metzner, Wilmington, Del.; Raymond C. Vaseleski, Charleston, W. Va.; Wei-Kuo Lee, Millburn, N.J.

[73] Assignee: The University of Delaware, Newark, Del.

[22] Filed: Oct. 11, 1974

[21] Appl. No.: 514,115

[52] U.S. Cl. ..... 137/13

[51] Int. Cl.[2] ..... F17D 1/16

[58] Field of Search..... 137/13; 160/308, 305 R; 252/8.55 R; 165/1

[56] References Cited

UNITED STATES PATENTS 3,351,079 11/1967 Gibson ..... 137/13

3,537,525 11/1970 Sarem ..... 252/8.5 X

*Primary Examiner*—Alan Cohan

[57] ABSTRACT

1. The reduction of turbulent drag of fluids flowing through conduits such as pipelines, channels, troughs and streams, or of drag on an object which is moving relative to a fluid, which comprises adding to said fluid a mixture of soluble polymeric substances and of suspended fibers.

2. Process fluids, consisting of the above-mentioned mixtures of dissolved polymers and suspended fibers, which exhibit decreased pressure losses under conditions of turbulent flow as compared to the carrier liquid but which exhibit heat or mass transfer rates which are of the same magnitude as those of the unmodified carrier liquid. That is, process fluids for which the heat transfer rate per unit of pumping power required is greater than that exhibited by the carrier fluid.

5 Claims, 5 Drawing Figures

PROCESS FOR REDUCING THE TURBULENT DRAG IN CONDUITS AND AROUND SUBMERGED OBJECTS

Figure 1:
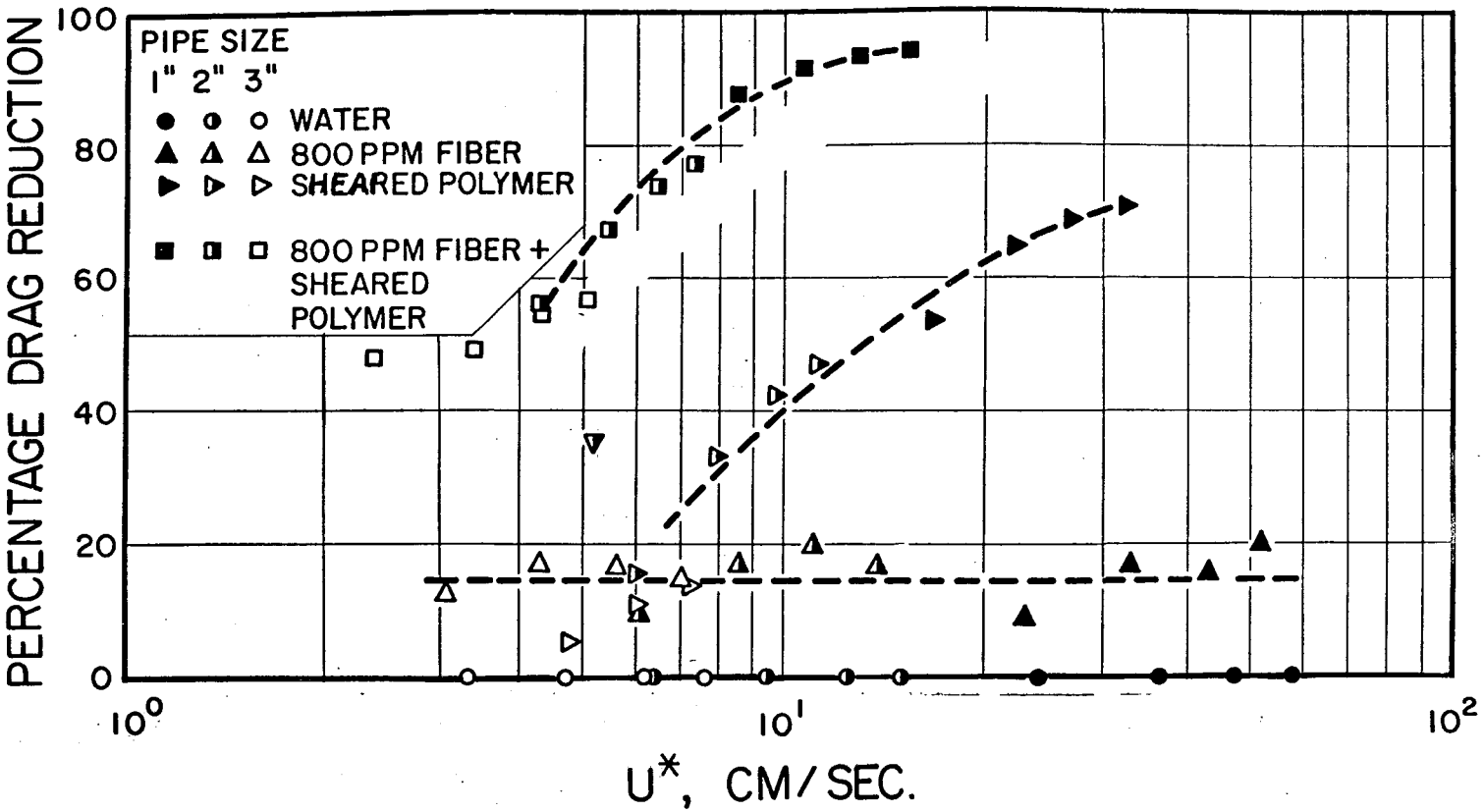

The Government has a right in this invention pursuant to Contract No. N-00014-70-A-D113-001 of the Department of the Navy.

FIELD OF INVENTION

This invention relates to a process for reducing the turbulent drag in conduits and around submerged objects by adding to fluids certain substances as well as to the fluid mixtures obtained thereby.

BACKGROUND OF THE INVENTION

Soluble polymeric additives have been known to reduce the drag, under turbulent flow conditions, and there is an extensive literature which treats this subject. For example, very high molecular weight additives such as polyethylene oxides, polyacrylamides, carboxymethycellulose and guar gum may result in high levels of drag reduction even at very low polymer concentrations. However these additives degrade very rapidly, due to the high stress levels to which they are subjected in the turbulent field, and hence are more useful in "one shot" applications, such as flow through a fire hose, than in flow through lengthy pipelines or other conducits. It has been determined that the mechanisms responsible for drag reduction using polymeric additives are located physically in or near the quasilaminar sublayer immediately adjacent to the solid surface. Although the reductions in drag obtainable using polymeric additives may be quite large the additives have not been extensively used: in addition to the problem of rapid degredation rate one notes that they are expensive and are less efficient in large scale systems than they are in a laboratory apparatus having small dimensions. Finally they are not of value as process fluids (as in a heat transfer loop in the chemical process industries) because, although the pumping power requirements are reduced below the levels exhibited by the unmodified carrier liquid, the heat transfer rates are reduced even more greatly. That is to say, the process fluid's efficiency, defined as the rate of heat transfer per unit of power expended, is lower for the drag-reducing solution than for the unmodified liquid. A comprehensive review of this entire subject of turbulent drag reduction has recently been provided by J. W. Hoyt in his article entitled "The Effect of Additives on Fluid Friction" Trans A.S.M.E. (J. Basic Eng.) 94D, 258 (1972). He shows that the maximum reduction in drag observed to date, with polymeric additives, is in the neighborhood of 80%.

Separately, it has been known for a long time that small particles, such as dusts, sediments and paper pulp fibers, when suspended in a turbulent fluid, will also reduce the drag on an object or the gradient of the fluid head in conduits. The magnitude of the drag reduction obtainable using suspended solids has not been as dramatic as in the case of polymeric additives, and the mechanisms by means of which this drag reduction occurs with suspended solids have not been elucidated. Recently, J. W. Hoyt in his article "Turbulent Flow of Drag-Reducing Suspensions" Naval Undersea Center Report TP 299, San Diego (1972) has been able to show that the reduction in drag obtainable with some fibrous additives, e.g. glass fibers and asbestos particles, may be quite large and possibly worth exploiting.

R. C. Vaseleski has been able to show in his M.Ch.E. Thesis at the University of Delaware, May, 1973, that the use of fibrous additives affects the turbulence in the "turbulent core" in flow through a conduit; i.e., the region removed from the laminar sublayer adjacent to the wall. Correspondingly, in the case of flow around submerged objects these fibrous additives would be expected to influence the turbulent field at some distance from the submerged object. A most important result of these observations is that the observable drag reduction is not affected adversely by increasing the scale of the system, at a constant value of the Reynolds number.

SUMMARY OF THE INVENTION

It has now been found that by ulitizing both fibrous and dissolved polymeric additives in a fluid one may achieve greater drag reduction than with either additive alone. Presumably this occurs because of some non-linear interaction of processes in the wall region which involve the polymeric additive and those in the external field or turbulent core which involve the suspended fibers. Hence, the effect of both additives is synergistic.

The following apparatus was used in determining the effect of additives on the turbulent drag in pipelines. A fluid storage tank with a stirrer and cooling coils was connected to a Moyno 2L10 bladeless pump that could force the fluid in turn through a Foxboro magnetic flow meter, a 30 foot section of pipe of selected diameter and then through a conduit back to the storage tank. Three 30 foot sections of rigid polyvinyl chloride pipe having inside diameters of 2.42, 4.87 and 7.03 cm respectively, were arranged in parallel so that by the use of valves any particular pipe section could be used. Manometer taps were provided in each pipe to enable measurement of the pressure drop as a function of flow rate through the pipes.

Water was used as the carrier fluid, and the tests were run using as the soluble polymer Separan AP30, a partially hydrolyzed polyacylamide manufactured by Dow Chemical Co., in its commercial form as well as in its degraded form as explained below. The fibers tested were two chrysotile asbestos fibers and a nylon fiber as more fully identified below. Viscometric measurements were performed on all fluids used by means of a capillary tube viscometer.

The choice of fibrous additives to be used was guided by the extensive data on fiber effectiveness published by Hoyt. The nylon fibers chosen were those obtainable from Microfibers, Inc. with a diameter of $20\mu$ and an aspect ratio (fiber length/fiber diameter) of 100. One asbestos fiber was from Turner Brothers Asbestos Company and the other from Johns-Manville Company (labeled 3T12). Turner Brothers report their asbestos fibril diameter as 30–40nm and the mean aspect ratio to be $4 \times 10^4$; no dimensions are available for the Johns-Manville asbestos.

The addition of surfactant was found to be desirable for the dispersion of asbestos fibers in water. The surfactant used in the two asbestos fiber suspensions was Aerosol OT obtained from Fisher Scientific Company. The concentrations of the surfactant in the solution was 0.8% for Turner Brothers fibers, as suggested by the manufacturer, and 0.25% for the Johns-Manville asbestos as recommended by Peyser (see the article entitled "The Drag Reduction of Chrysotile Asbestos Dispersions" in J. Applied Polymer Science 17, 421 (1973)).

No attempts to minimize or optimize the quantities or choice of surfactant additive were made--conservatively large quantities, to assure good dispersion, were employed.

Since the results may be sensitive to degradation and to dispersion of the solids, the experimental techniques employed must be described exhaustively. For each test solution the storage tank was initially cleaned and filled with a weighed amount of water (about 700 kg.). In the earlier phases of the work, the fibers (and the surfactant for the asbestos fibers) were poured into the storage tank directly, and the suspension was stirred with a low speed mixer. In the later part of this study, when the polymeric additive was introduced, somewhat different procedures were used. Since both the Turner Brothers asbestos fibers and the polymer solution were shear-degradable, only experimental results using fresh samples were collected.

For the systems with polymer and nylon fiber suspensions, weighed amounts of polymer were sifted into the water in the storage tank. The polymer solution was then pumped through the test loop for 3 hours as a "pre-shearing" procedure before the fibers were added, so as to virtually eliminate the shear degradation problem. After the pre-shearing, nylon fibers were poured into the sheared polymer solution and dispersed moderately with a mixer. Finally, for the JM asbestos fibers, soap solution was prepared in the storage tank before the polymeric powder was sifted in and dissolved. The polymer-soap solution was then "pre-sheared" through the test loop for 8 hours. A well dispersed asbestos fiber suspension, which was prepared separately in about 45 kg. of soap solution, was then poured into the sheared polymer-soap solution for our tests. In order to save material and time, a new (higher) concentration of suspension was made up by making additions to the previous batch. In the solutions with polymer additive, no further polymer was added in these later stages. Thus, the polymer concentrations in the solutions with higher fiber concentrations were lower than the value (150 wppm) we report, having been reduced by about 10 ppm by each fiber addition.

The results of the experimental work are best shown in the attached drawings showing graphs of the experimental results.

FIG. 1 shows the actual (experimental) reduction in pressure drop plotted vs. the "friction velocity" of the fluid in the pipe. A zero percentage of drag reduction implies the usual behavior of Newtonian fluids--coincident with what practitioners of the art refer to as the "von Karman line" for turbulent flow inside smooth tubes. A 100% drag reduction would imply passage of the fluid through the pipe without any pressure losses whatsoever. The symbols S, M, and L refer to pipes having inside diameters of 2.4, 4.9 and 7.0 cm., respectively. All systems shown contain 0.25% wetting agent; the polymer used was Separan AP30 and the fibers were particles of JM asbestos 3T12. It is seen that at a friction velocity of 10 cm/sec the fiber alone leads to a 15% drag reduction, the polymer alone to a drag reduction of about 40% and the two together to a reduction in drag of about 90%.

Figure 2:
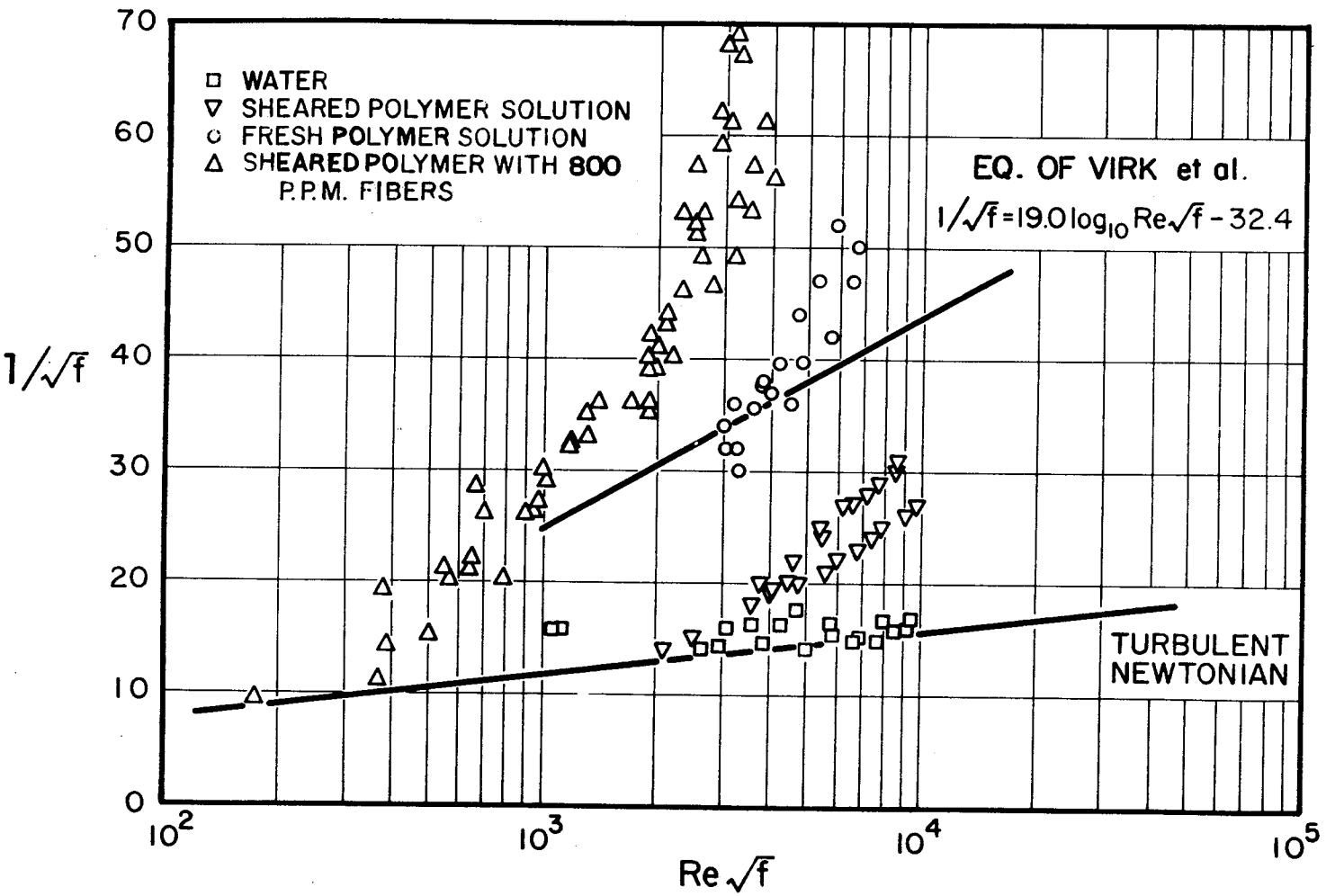

Similar results are shown in FIG. 2, for flow through the 2.4 cm pipe, in a dimensionless form common to this area of fluid mechanics. The friction factor $f$ is a measure of the magnitude of the drag; large values of the ordinate 1 $f$ therefore imply a very low drag or a great reduction in the drag. The abscissa is a dimensionless flow rate. Referring to this figure one sees the usual curve for pure fluids (Newtonian fluids) supported by the measurements for water. The equation of Virk et. al., referred to in the article entitled "The Ultimate Asymptote and Mean Flow Structure in Tom's Phenomenon" (Trans. A.S.M.E. (J. Applied Mech.) 37E, 488 (1970)), is supported, though only roughly, by the data for fresh polymer solutions. This equation has been labeled as the "maximum possible drag reduction" asmyptote for polymeric additives. Turning to the sheared polymer data one sees that at an (abscissa) value of the dimensionless flowrate of 4000 the ordinate has a value of about 20. Addition of 800 p.p.m. of fibers increases the ordinate to a level of 60 or more; such a 3-fold change in 1 $f$ corresponds to a 9-fold change in the dimensionless pressure drop $f$. This figure also shows how the fibers may be added to a sheared (degraded) polymer solution which has amost no drag-reducing properties to produce a highly effective mixture.

Figure 3:
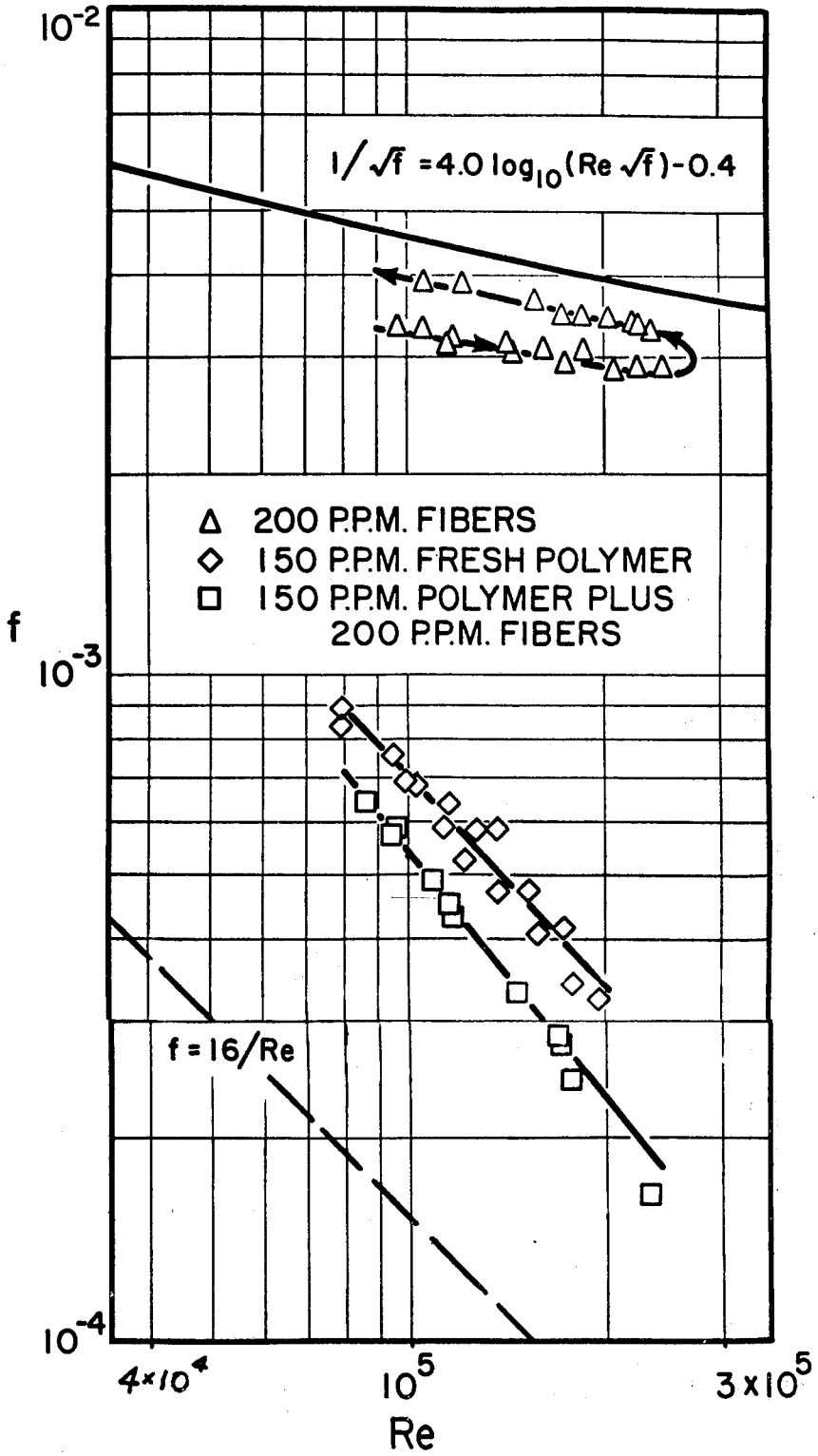
Figure 4:
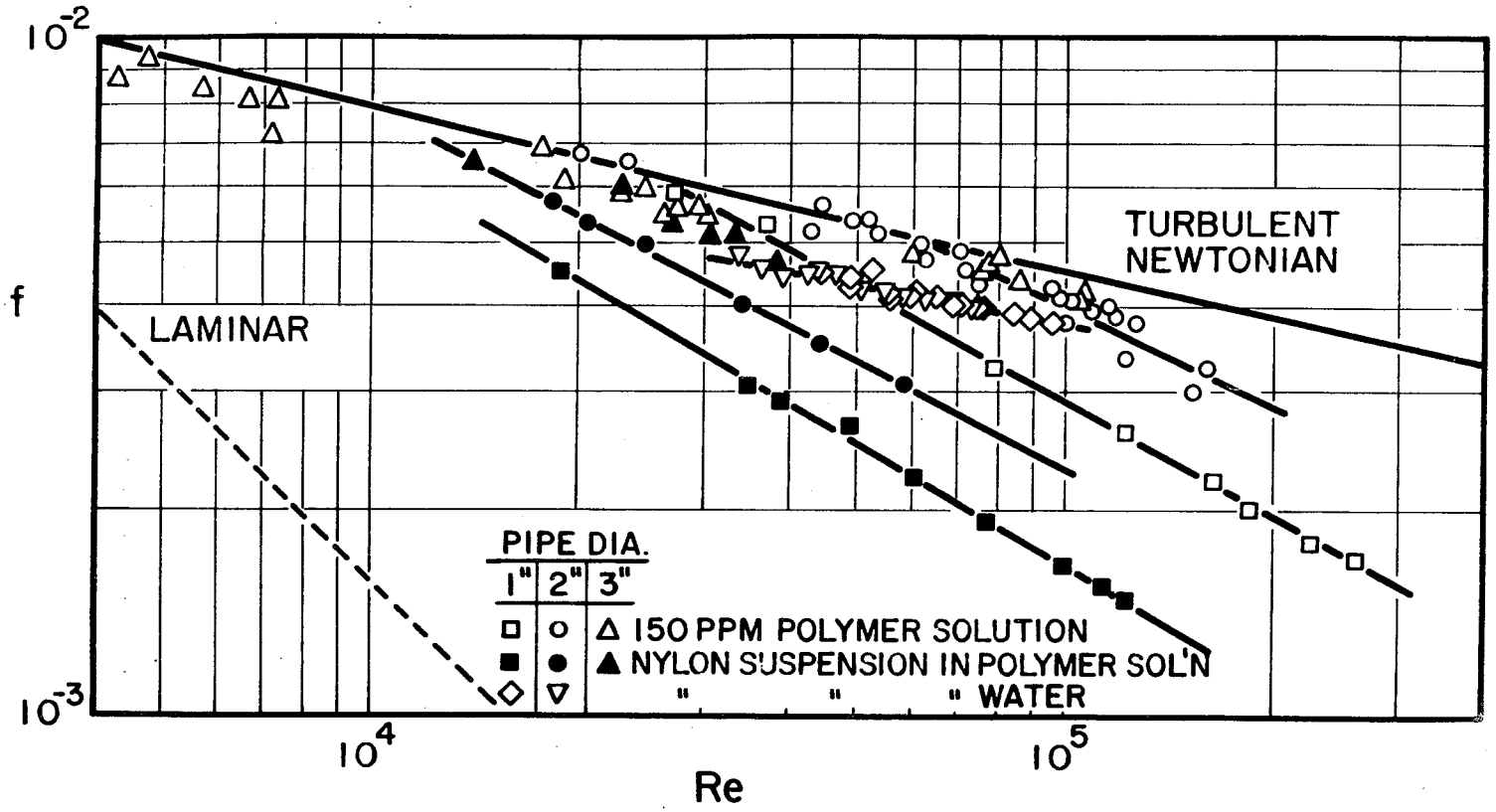
Figure 5:
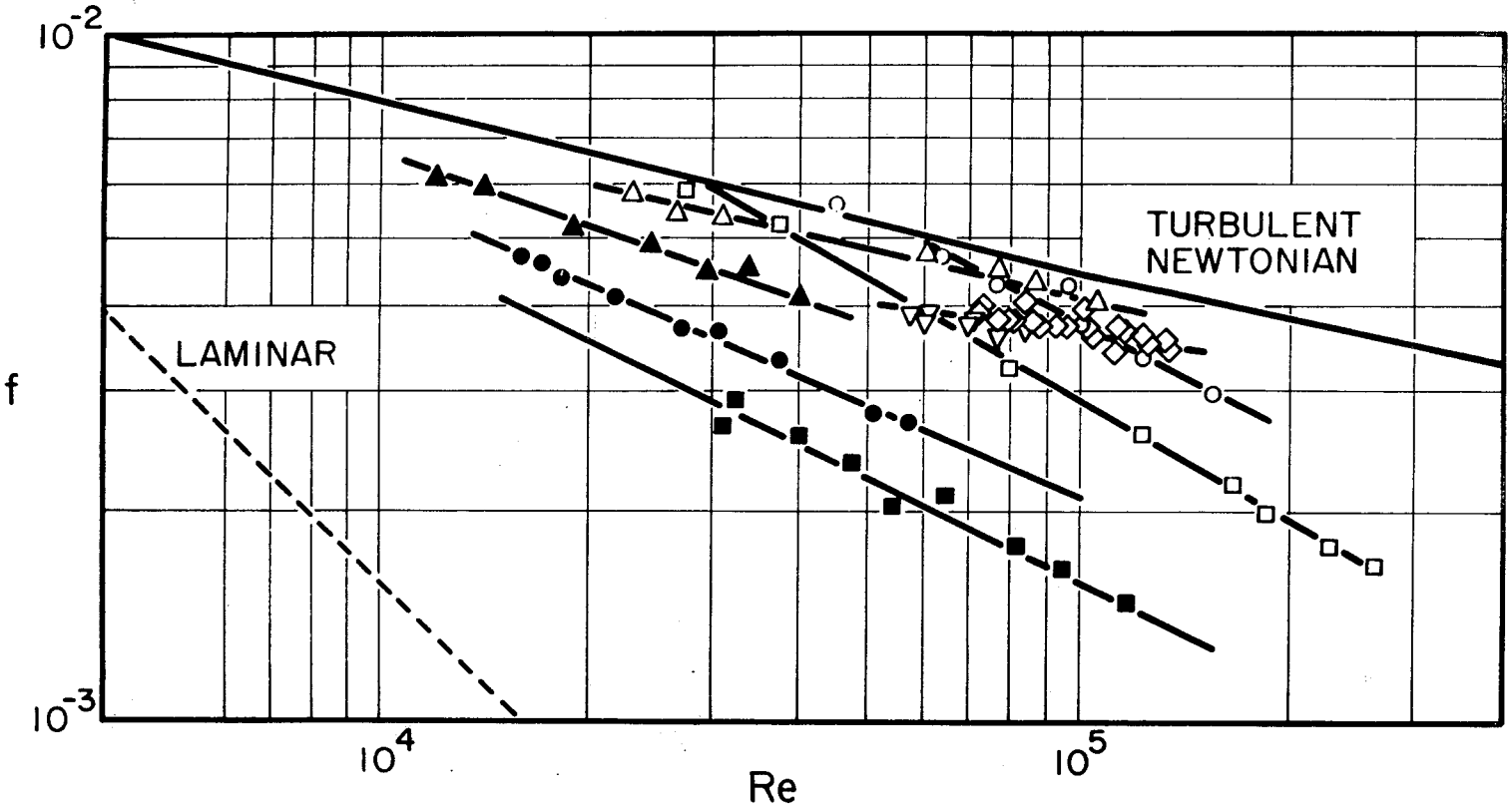

The previous examples illustrated the behavior of a mixture of Johns-Mansville asbestos fibers, 3T12, with Separan AP30, a polyacrylamide manufactured by Dow Chemical Company. FIG. 3 depicts results for mixtures of this same polymer with an asbestos suspension obtained from Turner Brothers Asbestos Company, England. The systems contain 0.8% of the surfactant. FIGS. 4 and 5 show the results for the carrier fluid with nylon fibers, carrier fluid and polymer and a mixture of polymer and nylon fibers in the carrier fluid. FIG. 4 refers to 1,000 w.p.p.m. of fibers and FIG. 5 to 10,000 w.p.p.m. (1% by weight). The legends in FIG. 4 apply to FIG. 5. These systems did not require surfactant for dispersal of the fibers and so none was used.

The following two tables summarize these sets of results. It is seen that even though the polymer alone may not reduce the drag at all it still possesses the ability to augment the drag reduction of the fiber suspension. This is a most important observation: polymers, which are less effective (of lower molecular weight) may be employed and such polymers of lower molecular weight are much more resistant to degradation.

TABLE I

Reductions in Turbulent Drag Coefficient in Polymer-Fiber Mixtures (JM Fibers)

| Nominal Pipe Diameter | Reynolds Number | Fiber Concentration w.p.p.m.* | Percentage reduction in drag coefficient obtained using: Fiber Additive Alone** | Polymeric Additive Alone** | Both Additives Together** |
|---|---|---|---|---|---|
| 2.4 cm. | $2 \times 10^5$ | 200 | 2.5 | 64 | 73 |
| | | 800 | 19. | 64 | 92.5 |
| | $10^5$ | 200 | 4.5 | 50 | 64 |
| | | 800 | 21. | 50 | 89 |
| 4.9 cm. | $10^5$ | 800 | 18. | 40 | 78 |
| 7.0 cm. | $10^5$ | 200 | 13. | 27 | 44 |

TABLE I-continued

| Reductions in Turbulent Drag Coefficient in Polymer-Fiber Mixtures (JM Fibers) | | | | | |
|---|---|---|---|---|---|
| | | | Percentage reduction in drag coefficient obtained using | | |
| Nominal Pipe Diameter | Reynolds Number | Fiber Concentration w.p.p.m.* | Fiber Additive Alone** | Polymeric Additive Alone** | Both Additives Together** |
| | | 800 | 22. | 27 | 63 |

*Parts per million by weight.
**All systems contain 0.25% surfactant.

TABLE II

| Reduction of Turbulent Drag Using Turner Brothers Asbestos or Nylon Additives | | | | | |
|---|---|---|---|---|---|
| | | | Percentage reduction in drag coefficient using: | | |
| Nominal Pipe Diameter | Reynolds Number | Fiber Concentration w.p.p.m. | Fiber Additive Alone* | Fresh Polymeric Additive Alone* | Both Additives Together* |
| 2.4 cm. | $2 \times 10^5$ | 200 TB | 14–27** | 91 | 94 |
| | $10^5$ | 200 TB | 13–22** | 84 | 88 |
| 4.9 cm. | $10^5$ | 200 TB | 15–28** | 67 | 73 |
| | | | | Degraded | |
| 2.4 cm. | $10^5$ | 1,000 nylon | 15 | 36 | 63 |
| 4.9 cm. | $5 \times 10^4$ | 1,000 nylon | 17 | 0 | 36 |

Polymer concentration: 150 w.p.p.m. in all cases.
*The asbestos systems contain 0.8% surfactant, the nylon systems contain none
**Level depends on extent of fiber degradation.

DESCRIPTION OF THE UTILITY OF THE INVENTION

Typically, the reduction in drag which is obtainable using polymeric additives is in the neighborhood of 50–80%, if the additives are highly efficient. The greatest reduction in drag obtained to date with a combined system is 95%. This represents a twenty-fold reduction in power costs, for conveying fluids through a pipeline. If the power supply is fixed one is able to increase the flowrate by a factor of approximately 3 with such large reductions in drag at a given flowrate.

Polymers of low molecular weight or suspended fibers are, by themselves, not especially attractive drag reducing additives since the drag reduction levels attainable are not very great under conditions of normal usage. In combination they possess an enormous advantage, however, over polymeric systems of high molecular weight, in their great resistance to degradation. This work has shown that by combining these systems one may obtain very large reductions in drag, while concomitantly exploiting their resistance to degradation. In long conduits the polymer or fibers may be added at stations along the pipe to replace material that becomes completely degraded.

It is well known to practitioners of the art that process fluids commonly used as heat mass transfer media in the chemical process industries exhibit resistances to heat transfer which are concentrated in the sublayer region immediately adjacent to the surface being heated or cooled, providing dimensionless groups known as the Prandtl or Schmidt numbers are appreciably greater than unity. All known homogeneous process liquids other than liquid metals fall into such a region of "high" Prandtl or Schmidt number. Additives which thicken this sublayer, such as dissolved polymers, would be expected to decrease the rates of heat transfer. This expectation has been confirmed and the engineering literature shows that the reduction in heat transfer rate is generally greater than the reduction in drag; i.e. polymeric drag reducing fluids are usually unsatisfactory process fluids in that the heat transfer obtainable per unit of pumping power expended is lower than in the case of the unmodified carrier liquid.

We have been able to show that the effect of fibrous additives tends to be concentrated on the "turbulent core" of the velocity field. Reductions in drag obtained in this way would not be expected to have any strongly deleterious effect on the heat transfer rates. Thus, systems containing suspended fibers and dissolved polymer may exhibit properties which are highly desirable from the viewpoint of a process fluid application.

We claim:

1. A process for reducing the turbulent drag of a fluid in a conduit or around a submerged object which comprises adding to the fluid a soluble polymer and a dispersable non-soluble fibrous substance having an aspect ratio of at least 100.

2. The process of claim 1 in which the carrier liquid contains 10–10,000 p.p.m. of the suspended fibrous substance and 1–2,000 p.p.m. of the dissolved polymeric matter.

3. A process of claim 1 in which the polymeric material used is chosen from the commonly-known inventory of satisfactory drag reducing polymeric additives but is of such a state of molecular weight or of degradation that, by itself, it exhibits little or no drag reduction in flow processes of a scale which are of practical interest.

4. A process of claim 2 in which the polymeric material used is chosen from the commonly-known inventory of satisfactory drag reducing polymeric additives but is of such a state of molecular weight or of degradation that, by itself, it exhibits little or no drag reduction in flow processes of a scale which is of practical interest.

5. A process, having as either its primary or important secondary purpose, the transfer of heat and/or mass from a process fluid stream in which a dissolved polymer and a dispersed non-soluble fibrous substance having an aspect ratio of at least 100 are added to the process fluid for the purpose of reducing the turbulent pressure drop required to pump the fluid stream.

* * * * *